US005269615A

United States Patent [19]

Lewis, Jr.

[11] Patent Number: 5,269,615

[45] Date of Patent: Dec. 14, 1993

[54] GRIP CLEANING DEVICE

[75] Inventor: John C. Lewis, Jr., Salisbury, Vt.

[73] Assignee: Sulew, Inc., Salisbury, Vt.

[21] Appl. No.: 927,535

[22] Filed: Aug. 24, 1992

Related U.S. Application Data

[63] Continuation of Ser. No. 706,833, May 29, 1991, abandoned.

[51] Int. Cl.[5] ..... A47L 13/17

[52] U.S. Cl. ..... 401/9; 401/10; 401/11; 401/139; 401/284

[58] Field of Search ..... 401/9-11, 401/137, 139, 284

[56] References Cited

U.S. PATENT DOCUMENTS

| | | | |
|---|---|---|---|
| 2,408,481 | 10/1946 | Reid | 401/11 X |
| 2,672,633 | 3/1954 | Allen | 401/11 X |
| 3,107,388 | 10/1963 | Groves | 401/11 X |
| 3,224,029 | 12/1965 | Domingos . | |
| 3,604,043 | 9/1971 | Lewis, Jr. . | |
| 4,291,431 | 9/1981 | Lewis, Jr. . | |
| 4,554,696 | 11/1985 | Nye, Jr. . | |
| 4,676,839 | 6/1987 | Osborn . | |
| 4,690,277 | 9/1987 | Lewis, Jr. . | |
| 4,701,968 | 10/1987 | Stoltzman | 401/11 X |
| 4,899,409 | 2/1990 | Cox | 15/104.04 X |
| 4,923,316 | 5/1990 | Fattal | 401/11 |
| 4,953,999 | 9/1990 | Rivers | 401/9 |

FOREIGN PATENT DOCUMENTS

| | | | |
|---|---|---|---|
| 2192798 | 1/1988 | United Kingdom | 401/10 |

*Primary Examiner*—Danton D. DeMille

*Attorney, Agent, or Firm*—Lowe, Price, LeBlanc & Becker

[57] ABSTRACT

A grip cleaning device is disclosed for removing debris, sweat and/or other foreign matter from the grip material on athletic equipment such as golf clubs, rackets of all kinds and handle grips on bikes and the like. The device includes tufts with working ends defining a cleaning surface for the grip and an integral cleaning liquid dispenser.

12 Claims, 6 Drawing Sheets

GRIP CLEANING DEVICE

This application is a continuation of application Ser. No. 07/706,833 filed May 29, 1991 now abandoned.

FIELD OF THE INVENTION

The invention relates to an apparatus for removing debris from grips and grip wound athletic equipment in general. The grip to be cleaned is inserted into the device with a back and forth motion along the length of the grip which allows the special brushes contained therein to clean. Simultaneously, a liquid is sprayed on the grip allowing debris and the like to be worked loose and fall away.

DESCRIPTION OF THE PRIOR ART

Many different types of grip debris removers are known. For example, Pat. Nos. 3,224,029 and 4,554,696 issued to J.G. Domingos and G.P. Nye, Jr. respectively, describe brush-type grip cleaners to remove dirt and debris from the grip portion of the handle. The devices described are large and stationary. Domingos is manually operated while Nye is electrically operated. U.S. Pat. No. 4,676,839 issued to J.S. Osborn illustrates a large powered grip cleaning device wherein multiple grips are simultaneously cleaned. This device is also electrically operated and, therefore, tied to a fixed location. These devices also use brushes having working ends substantially at a common distance from an axis so that the brushes do not conform to grip configurations. U.S. Pat. No. 3,604,043; 4,291,431 and 4,690,277 issued to John C. Lewis, Jr. disclose tufted fused mat-like devices wherein synthetic filament tufts are fused to molded base sections and methods of making the same. There are no disclosures therein of the improved brush mat structure of the instant invention, where a brush mat has been trimmed having a working surface configured to conform to the outer surface of a grip nor is it obvious to one skilled in the art to arrive at this new and novel cleaning device.

SUMMARY OF THE INVENTION

The instant invention provides an efficient grip cleaner by providing a mat of integral synthetic filament tufts radiating inward from a thin molded base, trimmed to form a working surface which coincides with the external surface of the object to be cleaned. The brush mat contained within the device of this invention and the housing therefor have open end sections thus allowing the grip object to be indexed therethrough. While indexing the grip portion back and forth through and in contact with said brush, a liquid (or powder) is sprayed onto the grip which helps loosen or dissolve any foreign material lodged in and/or on the grip. Also, the small size of the novel device allows for the twisting and rotation of the brush around the grip while the said grip is indexed back and forth through the brush. This action gives total contact of the brush working ends of the filaments to the grip surface, wherein the prior art, the grip portions cannot be indexed through the stationary cleaners because of closed ends, and the working ends only sporadically contact the grip.

The improved device of this invention generally includes a hand-held integrally molded container base portion connected to a larger parallel hollow housing with open ends, means located at the open ends for holding a preferably removable brush mat therein, a flexible fused brush mat having its brush face surface angled and inwardly directed to form a center cavity (circular or polygonal in cross-section-section). The sides of said cavity, defined by the working ends of the brush mat face generally are at least three times as long as the width thereof. A spray-type dispenser, for liquid or powder is located atop the liquid container section.

It is therefore an object of this invention to provide a grip or handle cleaning device which is self-supporting and can be securely held in one's hand during use.

Another object of the instant invention is to provide a portable device which can easily be stored or carried in a bag; i.e., golf bag, knapsack-sack, sports equipment bag and the like.

A further object of this invention is to provide a grip or handle cleaning device which contains means for applying a liquid or solid agent to the grip or handle during cleaning.

Another object is to provide a cleaning surface located within the device which maximizes the contact between the shape of the grip and the cleaning object, i.e., brush ends.

DESCRIPTION OF THE PREFERRED EMBODIMENTS

Figure 1:
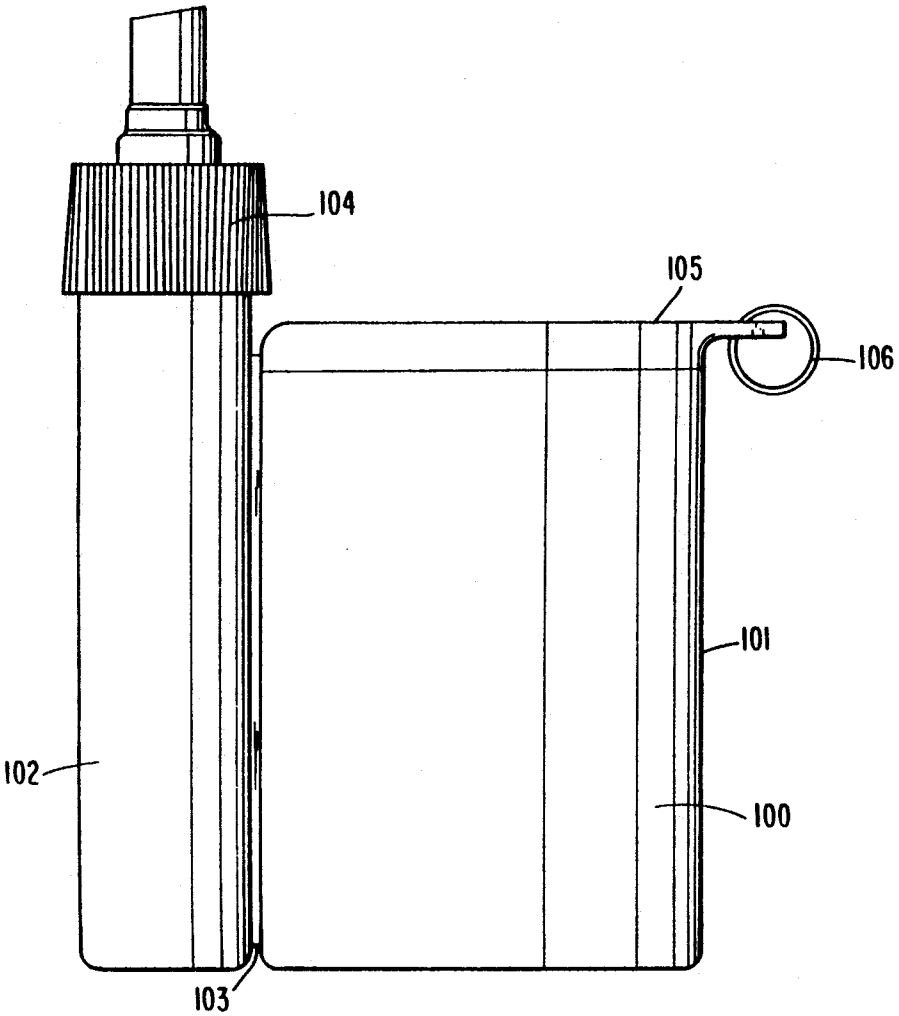
FIG. 1 is a side view of the grip cleaning device of this invention.

A golf club grip cleaner device 100 of the instant invention is shown in FIG. 1. The device is made with two integrally connected housings. The first housing 101 has open ends and contains a brush mat means, while the second housing 102 has a closed bottom and a pump means 104 screwed onto the top. A vertical integral web 103 connects the two housings. A top 105 is snap-fitted on to the housing 101 and may have a hanger means 106.

Figure 2:
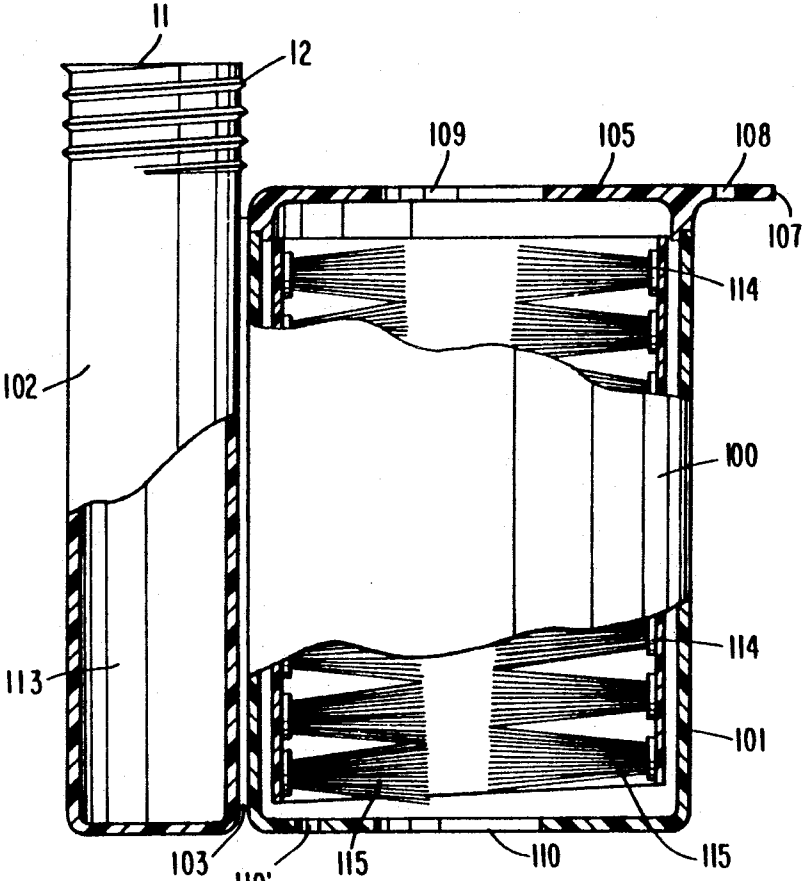
FIG. 2 is a partial cross-sectional side view of the grip cleaner device of FIG. 1.

FIG. 2 illustrates the brush means 114 of fused tufts 115 and shows the vertical attitude within the housing 101 with opening 109 in top 105 and open bottom 110. The bottom of housing 101 may also contain small openings 110' in order to allow for drainage. Side top 105 has a projection 107 which has opening 108. Any suitable clip or hook means such as ring 106 may be attached through opening 108 in order to hang or clip the grip cleaner device to another object.

Threads 112 are located at the top 111 of housing 102 for receiving a conventional pump 104. The interior 113 of housing 102 holds any suitable liquid or solid which can be subsequently sprayed or forced through the pump means 104.

Figure 3:
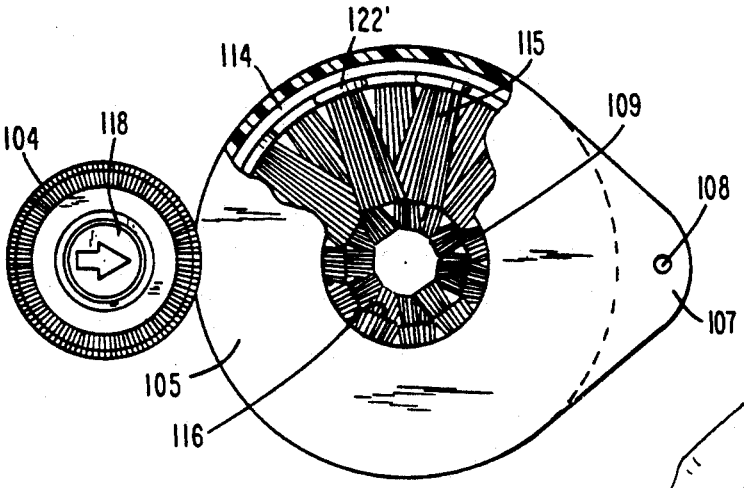
FIG. 3 is a top view of the grip cleaning device with a portion of the housing removed illustrating the brush tufts as contained within the main body.

In order to clean or polish a grip surface, the brush unit must contact the surface of the grip in a substantially continuous fashion. Therefore, it is necessary to design the brush means in such a manner as to allow the trim or working ends of the filament tufts to define the shape and surface of said grip. In FIG. 3, the brush means 114 is shown with tufts 115 at or near the top opening 109 to converge and form a circular cavity 116. Looking into the cavity 116, the tufts 115 are shown converging in a smaller circular opening 117. The pump means 104 is shown with a push down button 118 and arrow illustrating the direction of the spray when used.

Figure 4:
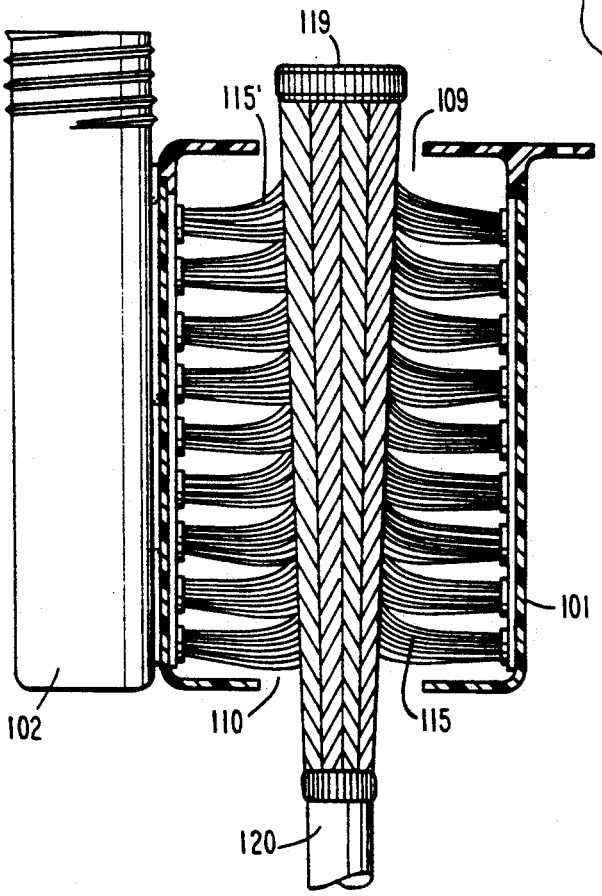
FIG. 4 is a cross-sectional view of the grip cleaning device illustrating the brush in contact with a grip end of a golf club.

FIG. 4 illustrates the action of the tufts 115 upon the grip 119 attached to the club shaft 120. The length of the filament tufts 115 are trimmed in such a manner so that when the grip 119 is indexed through the bottom opening 110 of the chamber 101 and pushed in and out and up through the top opening 109, the filament ends of tufts 115 bend and put extra pressure at 115' on the grip. The reversing back and forth of the grip through the tufts with the constant and even pressure subsequently removes debris and refurbishes the surface of the grip 119.

Figure 5:
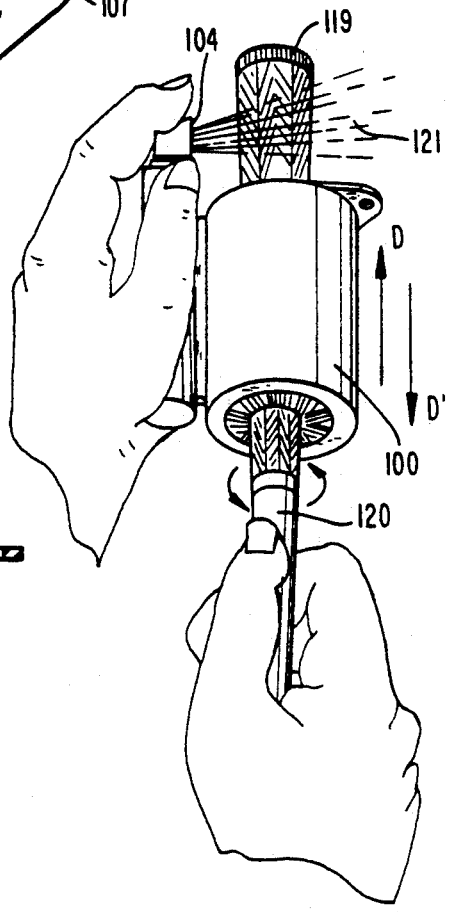
FIG. 5 is a perspective view of FIG. 1 illustrating the actual use of the grip cleaner device of this invention.

FIG. 5 illustrates the actual use of the device 100. While holding the device 100 in one hand, and pushing down on the pump means 104, a liquid 121 is sprayed on the grip 119, and at the same time the golf club shaft 120 is slightly rotated in a circular motion and indexed in and out (up and down) through the device 100 in directions D and D'.

Figure 6:
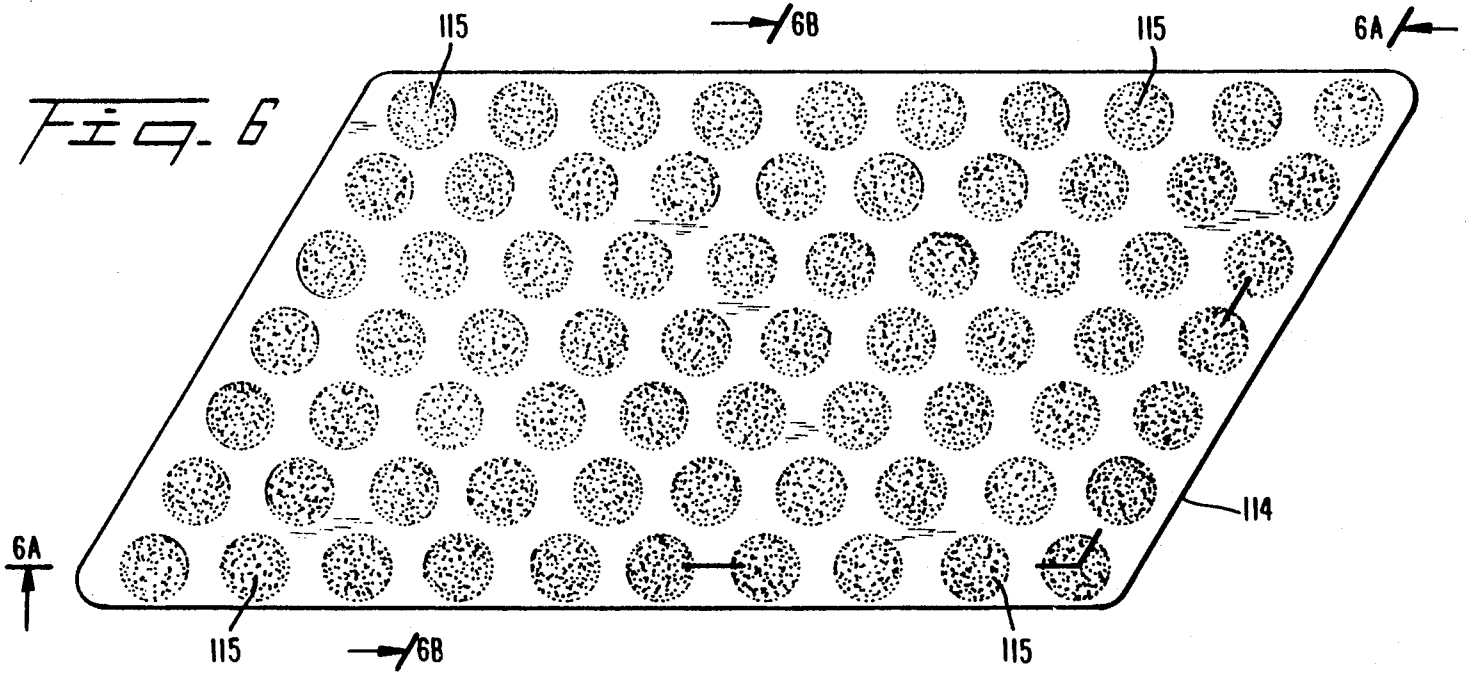
FIG. 6 is a top view of the brush mat prior to insertion into the main body of the device.
Figure 6A:
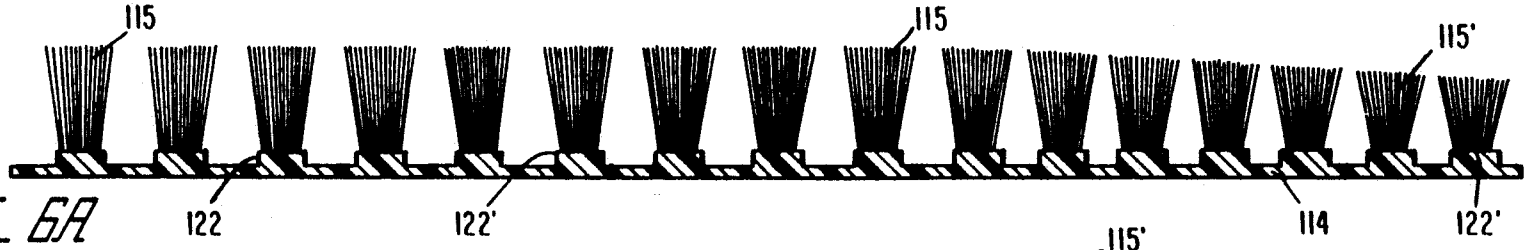
FIG. 6A is a cross-sectional view of the mat in FIG. 6 as taken along lines A—A.
Figure 6B:
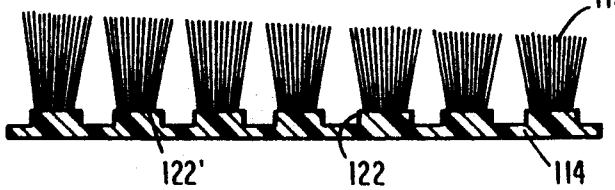
FIG. 6B is a cross-sectional view of FIG. 6 as taken along B—B.
Figure 7:
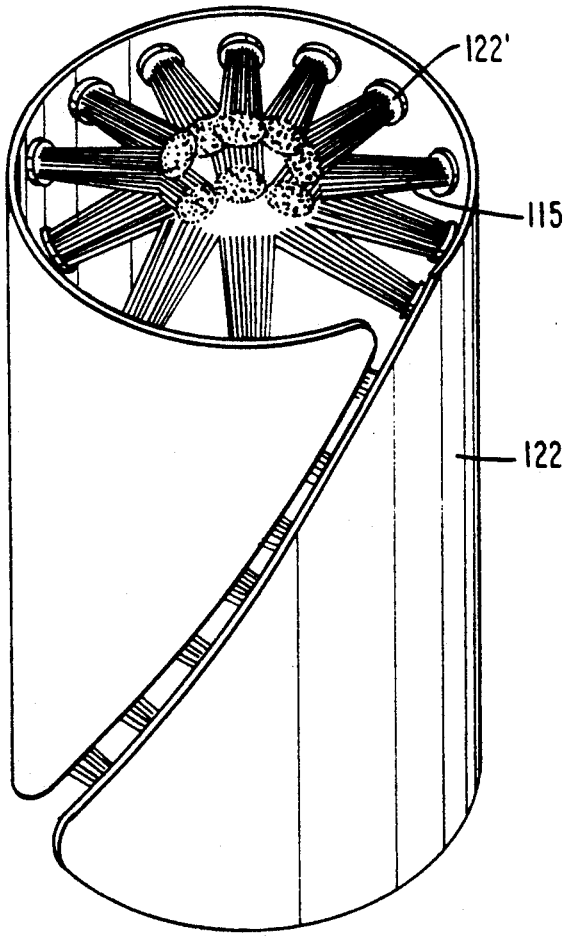
FIG. 7 is a perspective view of the mat in FIG. 6 prior to insertion into the main body of the grip cleaner device.

The importance of the trimmed brush means 114 as shown in FIGS. 6, 6A and 6B lies in the fact that whatever the shape of the grip to be cleaned, contact with working ends of the tufts must take place in order that all the surface of the grip is simultaneously cleaned, i.e., wet cleaned, dry cleaned, roughed-up refurbish surface, and the like. The brush mat 114 of the instant invention illustrated in FIG. 6 actually is made by first fusing filament tufts 115 on to the surface 122. The tufts are fused at the junction of 122' and are integrally fused from the same material as the mat base. For example, the molded base mat 114 can be polypropylene, and the filaments likewise. FIG. 6A illustrates the special trim given to the surface of the brush mat 114 as taken through lines A—A. Note the trim length varies from the front to the back as shown in FIG. 6B as taken through lines B—B of FIG. 6. And when the brush mat 114 is formed into a circular longitudinal configuration as shown in FIG. 7, it can be inserted into the body section 101 of the device. A method for forming the mat of tufts with fused tufts is described in the above patents to Lewis and others cited therein.

Figure 8:
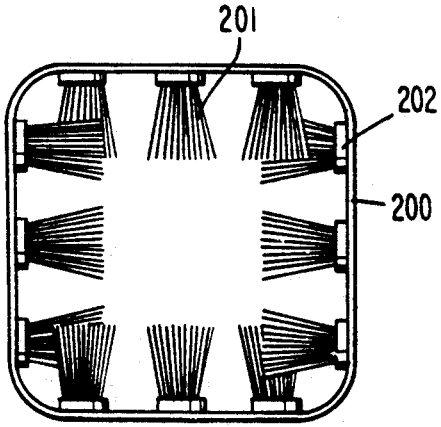
FIG. 8 is a cross-sectional view of a brush mat illustrating an alternate polygonal configuration.

Other grip devices can be made employing the same techniques, but other shapes and trims can be imparted to the brush portion thereof, thus as is illustrated in the cross-section of FIG. 8. The brush 200 of FIG. 8 has tufts 201 fused at 202 and take the shape of a more or less square. Such a shape may be employed for cleaning a tennis racket's grip.

The open-ended brush chamber may have a top that is fixed or removable. However, it is possible to mold the brush retaining section directly onto the top and bottom of said chamber, and fold or twist the brush mat member 122 of FIG. 7 in such a manner as to pass it through the opening 109 of chamber 101 of FIG. 2.

It is possible to remove the tufted mat brush member and replace it with a different configuration, if needed. Also, when the mat wears or becomes unable to sufficiently refurbish the grip member, a replacement mat may be exchanged for the original.

Figure 9:
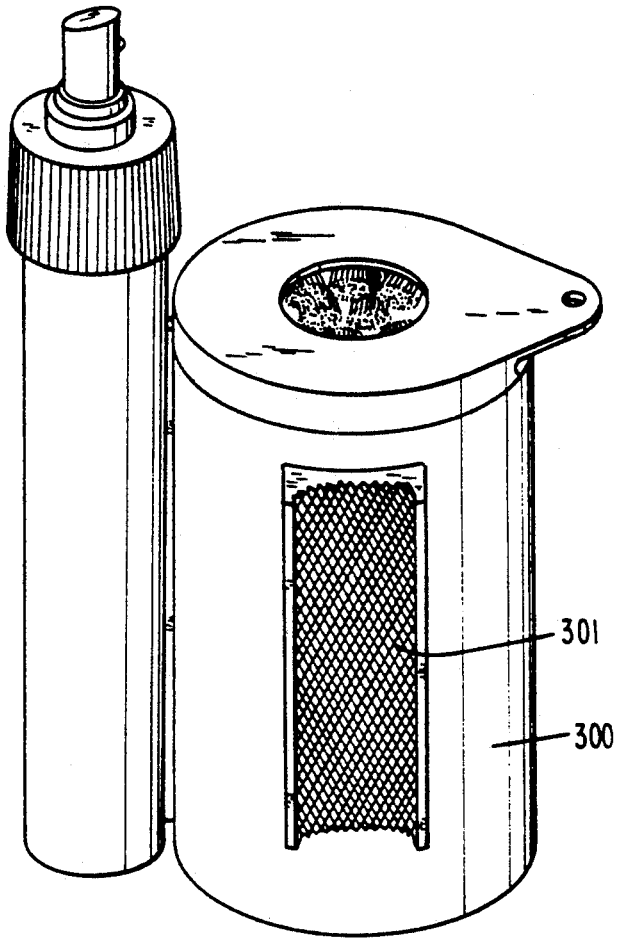
FIG. 9 is a perspective view of an embodiment of the grip cleaner device of this invention illustrating a file-like projection integral with the main body section.

Serrated or sharp-edged notches may be molded directly into the chamber's outside wall as shown in FIG. 9. The serrations 301 of chamber 300 can be used to rough-up the outside surface of a grip member.

Figure 9A:
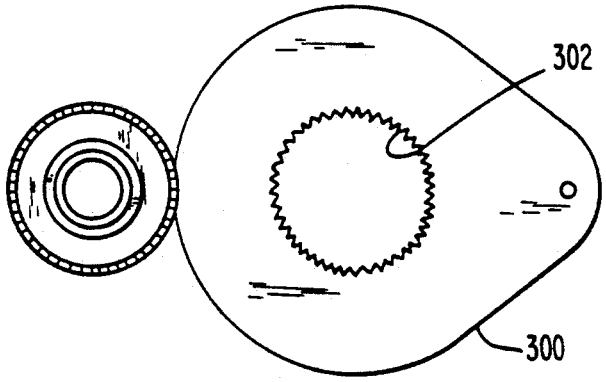
FIG. 9A is a top view of an alternative embodiment wherein file-like serrations are provided around an open end of the main body housing.

In the alternative of FIG. 9A serrations 303 can be molded surrounding an open end of chamber 300 to rough-up the outside surface of a grip member.

Figure 10:
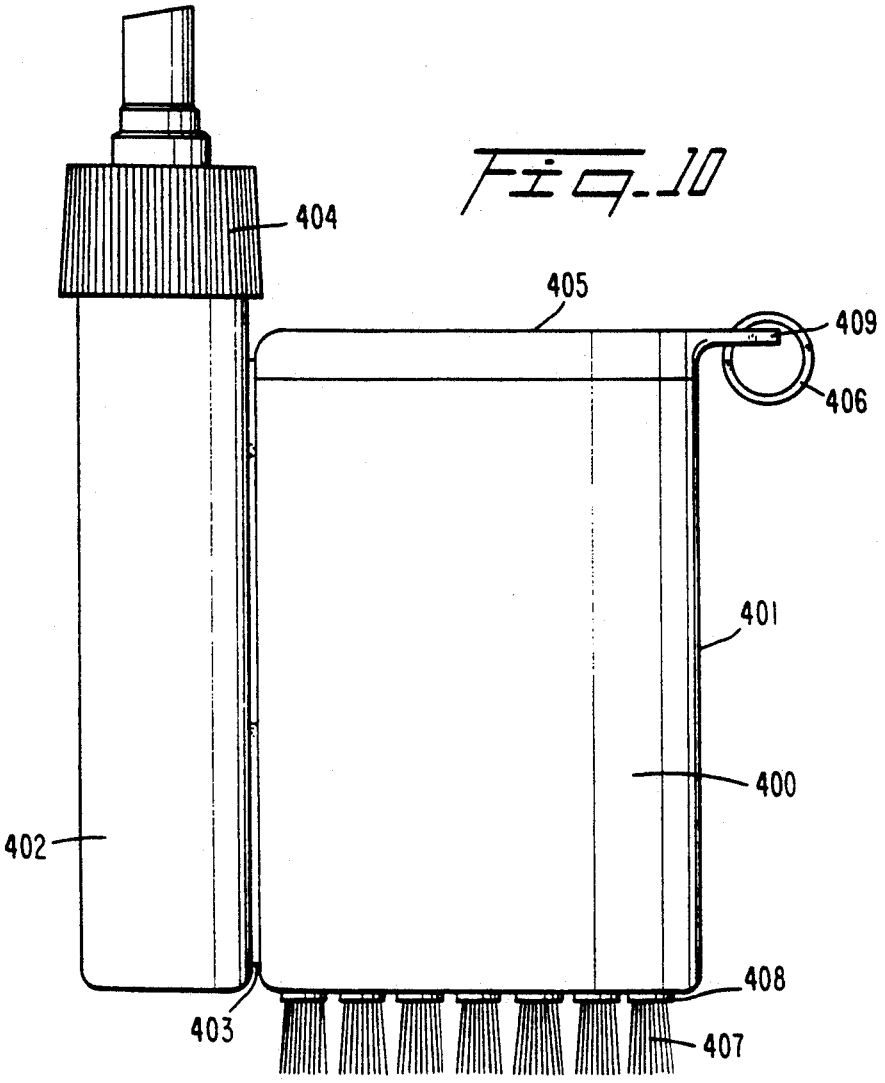
FIG. 10 is a side view of an alternative embodiment of the grip cleaning device of this invention with brush tufts integral with the bottom of the open chamber.
Figure 11:
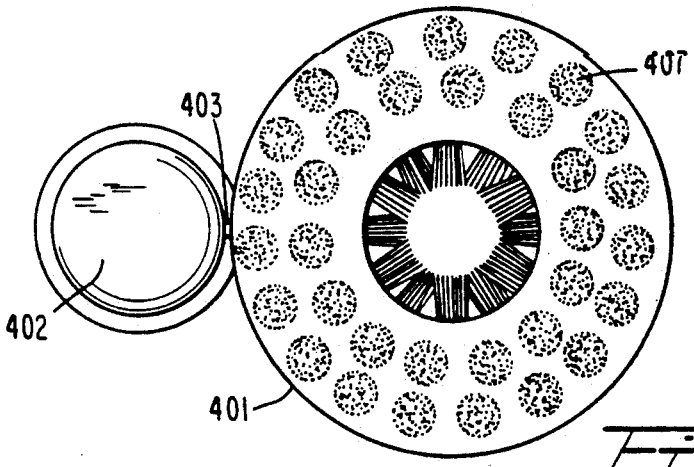
FIG. 11 is a bottom view of the device of FIG. 10.

FIG. 10 illustrates a golf club grip and wood (iron) cleaner device 400 of the instant invention having fused brush tufts 407 extending from bottom 408 of the open chamber 401. The brush tufts could be formed by various methods, i.e., fusing, staple-set, and the like. From an environmental standpoint, fusing the tufts is preferable. The top 405 has hook or hanger means 406 located on the outside parameter 409. Chamber 402 is integrally connected to chamber 401 by means of web 403, and has plunger means 404 located at the open end of said chamber. FIG. 11 illustrates the fused filament tufts 407 radiating from bottom 408 of chamber 401. These filament tufts 407 can be employed to brush away dirt and debris from a wood or iron club, and if required, a spray of some nature may be applied by first pumping a liquid or solid cleaner from housing 402 as connected to housing 401 by web 403.

Obviously many modifications and variations of the instant invention are possible in light of the above teachings. The device may be made from polypropylene molded resin and fused synthetic polypropylene monofilament as the preferred material, however, other synthetic resins such as polyesters, polystyrenes, polyamides and the like may be employed. Filament diameters and cross-sectional shapes may also be varied, with diameters ranging from 0.005 through 0.050 inches and cross-sectional shapes from circular, "X", "Y" and others shapes, thus imparting different cleaning attributes within the mat structure.

The base member may have a circular shape as well as any polygonal shape so long as it is possible to create a hollow-like space to accept a brush mat configuration.

The device of the instant invention may be employed to clean such items as golf grips, racket grips of all kinds, bike handle grips, fishing pole handles and any pole-like structures including garden tools and the like. Different brush mats can be substituted for different handle or grip configurations.

The types of liquid employed in pump 104 can range from water, water/alcohol solutions, detergents, oils, solvents, inorganic solutions and organic compounds. Powders can be employed when using a means for applying said powder type chemicals.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

I claim:

1. A grip cleaner device comprising:

an integrally molded first elongated cylindrical housing having a top and a bottom end and a continuous sidewall surrounding a longitudinal axis, and connecting said ends, each end being contained in a plane disposed perpendicular to the longitudinal axis of said housing and defining an axial opening; second elongated housing extending along the sidewall of said first housing having a closed bottom end, an open top end, and a continuous sidewall; and a web interconnecting said housings at the sidewalls thereof;

said first housing top and bottom ends each having retainer means radiating inwardly from the sidewall toward the longitudinal axis thereof and surrounding the axial openings in said ends for retaining a brush construction within said housing;

the top and bottom openings of said first open-ended housing being dimensioned to accept the cross-section of a predetermined grip member when said grip member passes through the openings;

metering means mounted in said second housing for dispensing a cleaning substance onto a grip member passing through the openings in said first housing said means including a spray nozzle extending outwardly through the open top end of said second housing and located above the adjacent top end of the first housing;

a fused, flexible tufted brush mat mounted within said first housing having trimmed tufts with working ends inwardly directed, said tufts converging toward the longitudinal axis of said housing and the working ends defining a cavity conforming to the outer configuration of a grip to be cleaned so that the working ends of the tufts surround and contact the grip's surface in a parallel attitude, thereby causing the working ends of said tufts to apply abrasive pressure to the said grip member.

2. The grip cleaner device of claim 1, further including drain means at the bottom end of said brush containing first housing for removing excess liquid or solid materials from said housing.

3. The grip cleaning device of claim 2, further including serrated file-like projections carried by one of the housings for refurbishing a grip member.

4. The device of claim 3 wherein the projections are integral with a side of said first housing.

5. The device of claim 3 wherein the projections surround an open end of said housing.

6. The grip cleaning device according to claim 2, wherein the housings and brush mat are comprised of recyclable polypropylene.

7. The grip cleaning device of claim 1, wherein the cross-sectional configuration of the brush mat cavity is circular.

8. The grip cleaning device of claim 1, wherein the cross-sectional configuration of the brush mat cavity is polygonal.

9. The grip cleaning device of claim 1 wherein said cavity conforms to the outer configuration of a golf club grip.

10. The grip cleaning device of claim 1 wherein said cavity conforms to the outer configuration of a tennis racket grip.

11. The grip cleaning device of claim 1 wherein said first housing is dimensioned to be hand held.

12. The grip cleaning device of claim 1 further comprising external tuft means mounted on said device for brushing solid materials from said grip to be cleaned.

* * * * *